US005383617A

United States Patent [19]

Deuchars

[11] Patent Number: 5,383,617

[45] Date of Patent: Jan. 24, 1995

[54] REFINER PLATES WITH ASYMMETRIC INLET PATTERN

[76] Inventor: Ian Deuchars, 4025 Briarwood St., NW., Salem, Oreg. 97304

[21] Appl. No.: 140,673

[22] Filed: Oct. 21, 1993

[51] Int. Cl.[6] ..... B02C 7/12

[52] U.S. Cl. ..... 241/298; 241/296; 241/261.2

[58] Field of Search ..... 241/260, 261.2, 261.3, 241/296, 297, 298

[56] References Cited

U.S. PATENT DOCUMENTS

| | | | |
|---|---|---|---|
| 1,169,228 | 1/1916 | Barker | 241/296 |
| 1,187,360 | 6/1916 | Martin | 241/296 |
| 1,400,123 | 12/1921 | Wolff | 241/298 |
| 1,662,572 | 3/1928 | Fryer | 241/261.3 |
| 3,149,792 | 9/1964 | Textor | 241/261.3 |
| 3,552,664 | 1/1971 | Herbert et al. | 241/261.3 |
| 4,039,154 | 8/1977 | Peterson | 241/261.3 |
| 4,772,358 | 9/1988 | Virving | 241/261.3 X |
| 5,112,443 | 5/1992 | Virving et al. | 241/261.3 X |
| 5,181,664 | 1/1993 | Kohler | 241/261.3 |

*Primary Examiner*—Timothy V. Eley
*Attorney, Agent, or Firm*—Chilton, Alix & Van Kirk

[57] ABSTRACT

An improved pattern of bars and grooves on the plates of a rotating disc refiner, whereby the inherent restriction in the transfer of material into the grooves of the refining zone is reduced relative to conventional designs. The invention can be implemented at one or both of the transition from an innermost, feed zone to an intermediate, refining zone, or the transition from an intermediate, refining zone to an outer, refining zone. The invention can be generally understood as providing an asymmetric or jagged transition line from one zone to another. The asymmetry can be seen in a plate segment, relative to the segment central axis, or it may be seen as a saw tooth shape with respect to laterally adjacent regions of the same zone. Preferably, a line connecting the inlets on laterally successive regions of a particular zone, defines a substantially continuous saw tooth shape or a succession of jagged, "Z" shapes.

6 Claims, 6 Drawing Sheets

REFINER PLATES WITH ASYMMETRIC INLET PATTERN

BACKGROUND OF THE INVENTION

The present invention relates to refiners, and more particularly, to the pattern of bars and grooves on the rotating plates of disc refiners.

Disc refiners are generally classified into "low consistency" and "high consistency" types. The former operate at ambient pressure on a feed slurry having a solids content of up to about 15%, whereas the latter operate on feed material having a solids content above about 30%, delivered under pressure. These percentages refer to the refining of lignocellulosic material, but the use of rotating disc refiners is not limited thereto.

Although low consistency and high consistency refiners operate in different regimes, the basic structure of the refiner is similar in one important respect. The refining action occurs as feed material passes generally radially outwardly between opposed, substantially circular, relatively rotating plates having a pattern of bars and intervening grooves. Work is performed on the feed material caught in the small clearance as bars cross each other, and the material moves generally radially outward through the grooves between the bars. In this manner, material fed between the plates near the axis of rotation experiences thousands of pressure pulses at bar crossings as it progresses in a generally outward direction over and through successive bars and grooves, to be discharged at the circumferential periphery of the plates in a more refined state.

Refining of different kinds of feed materials, or achieving desired variations in output quality from the same kind of feed material, depending on the end usage, dictate a variety of possible design optimizations with respect to the variables of plate diameter, throughput rate, gap size, and refining intensity. These variables are well known to practitioners in the relevant field. In general, however, refiner plates have a substantially annular inner zone characterized by very coarse bars and grooves, where the feed material is reduced in size and given a radial component of movement, without substantial refining action. A second, intermediate annular zone receives the material from the first zone and performs a relatively coarse refining action. An outer annular zone of relatively fine, closely spaced bars and grooves provides a higher degree of refining. In refiners in which only one disc rotates the plate through which the material is fed into the gap, is generally referred to as the feed end plate. This plate has the relatively coarse, breaker bars defining the feed zone. The stationary plate, commonly referred to as the control end plate, usually does not have the coarse breaker bars, and does not rotate (although it may be adjusted axially to control the gap width).

In conventional refiner plates, the transition between zones, generally appears circular. More specifically, the plates are usually formed by attaching a plurality of segments side-by-side onto the disc surface, with the zone transitions being symmetric on either side of a radially extending central axis on each segment. Viewed differently, a line connecting the inlets of successive grooves in a given zone, when extended laterally to the sides of a plate segment, fall symmetrically on either side of the segment central axis. Usually, such line follows the arc of a circle, or two lines intersect at the axis, forming the same angle relative to the axis.

Despite the apparent operational simplicity of this conventional inlet configuration, inspection by the present inventor of plates after refiner operation, indicates local areas of concentrated, excessive wear along the imaginary line connecting the inlets for a particular refining zone. Such excessive localized wear unnecessarily limits the useful lifetime of the plates. The present inventor believes such wear arises from localized restriction, or pinching, of material flow between zones. These restrictions arise not so much from the inherent flow areas as viewed on an individual plate or segment, but rather from the localized restricting effect which occurs when one plate rotates with a very close gap relative to a confronting plate.

SUMMARY OF THE INVENTION

It is an object of the invention, to provide a pattern of bars and grooves on the plates of a rotating disc refiner which increases the effective inlet flow area from a radially inner feed zone to a radially outer refining zone.

It is another object of the invention to provide an improved pattern of bars and grooves on the plates of a rotating disc refiner, whereby the inherent restriction in the transfer of material into the grooves of the refining zone is reduced relative to conventional designs.

The invention can be implemented at one or both of the transition from an innermost, feed zone to an intermediate, refining zone, or the transition from an intermediate, refining zone to an outer, refining zone.

The invention can be generally understood as providing an asymmetric or jagged transition line from one zone to another. The asymmetry can be seen in a plate segment, relative to the segment central axis, or it may be seen as a saw tooth shape with respect to laterally adjacent regions of the same zone. Preferably, a line connecting the inlets on laterally successive regions of a particular zone, defines a substantially continuous saw tooth shape or a succession of jagged, "Z" shapes.

More specifically, the invention is directed to a plate attached to a substantially circular disc for installation in a rotating disc refiner, whereby the plate is formed by a plurality of adjacent plate segments, each segment having a central axis extending radially and a pattern of raised bars and grooves defined between the bars. The pattern includes a pair of left and right regions on either side of the central axis, each region having a series of laterally alternating bars and grooves extending substantially in parallel such that each bar has a length defined by radially inner and outer ends, and the radially inner ends of laterally adjacent bars define the inlet of the intervening groove. A line connecting the groove inlets in the left region when extended to the central axis forms a first acute angle to the central axis and a line connecting the groove inlets in the right region when extended to the central axis, forms a second acute angle with the central axis. The lines so extended do not intersect each other at the center, or if they so intersect, the angles of intersection differ by at least about 5°. Thus, the left and right lines are asymmetric about the central axis. Moreover, the left and right regions within a segment, are preferably laterally adjacent to each other.

In another form, the invention provides that each segment has at least one substantially annular zone defined by a plurality of laterally adjacent regions, each region of a zone having a plurality of laterally spaced adjacent bars and intervening grooves of substantially the same width, each bar having radially inner and radially outer ends, and each groove having an inlet defined by the radially inner end of at .least one bar. A line connecting the inner ends of the bars that define groove inlets in one region when extended to the central axis forms a first acute angle to the central axis and a line connecting the inner ends of the bars that define groove inlets in another region when extended to the central axis forms a second acute angle with the central axis, wherein the lines when extended, do not intersect at the central axis.

In another embodiment, the line connecting the inlets of the grooves, can be jagged or otherwise non-uniform along a particular region of a zone. In this embodiment, a first, radially inner zone has a first arrangement of laterally spaced bars and intervening grooves, and a second zone situated radially outward of the first zone has a second arrangement of laterally spaced bars and intervening grooves, such that the outer ends of the bars in the first zone and the inner ends of the bars in the second zone are spaced from each other non-uniformly and thereby define a channel therebetween of non-uniform width which extends obliquely toward the central axis of the segment.

In yet another embodiment, the spaces between regions of different zones, define left and right channels which are asymmetric about the central axis of the segment. The channels can have either a substantially uniform width, or a non-uniform width, along the inlets of a given region.

The present invention provides a more uniform flow transition between zones, and reduces or eliminates restrictions which persist during most or all of a plate revolution. This results in a more even flow and better refining, while avoiding restriction-induced plugging. Viewed differently, the staggered inlet pattern minimizes localized pinching of the flow. By varying the lengths of the bars at the inlet to a zone, the possibility of developing a predictable wear point is reduced. Moreover, the invention reduces the area where the fiber flow is expected to pass through, without causing feeding, fiber/steam separation and vibration problems for the refiner.

BRIEF DESCRIPTION OF THE DRAWINGS

These and other objects and advantages of the invention will be described below with reference to the accompanying drawings, in which.

DESCRIPTION OF THE PREFERRED EMBODIMENTS

Figure 1:
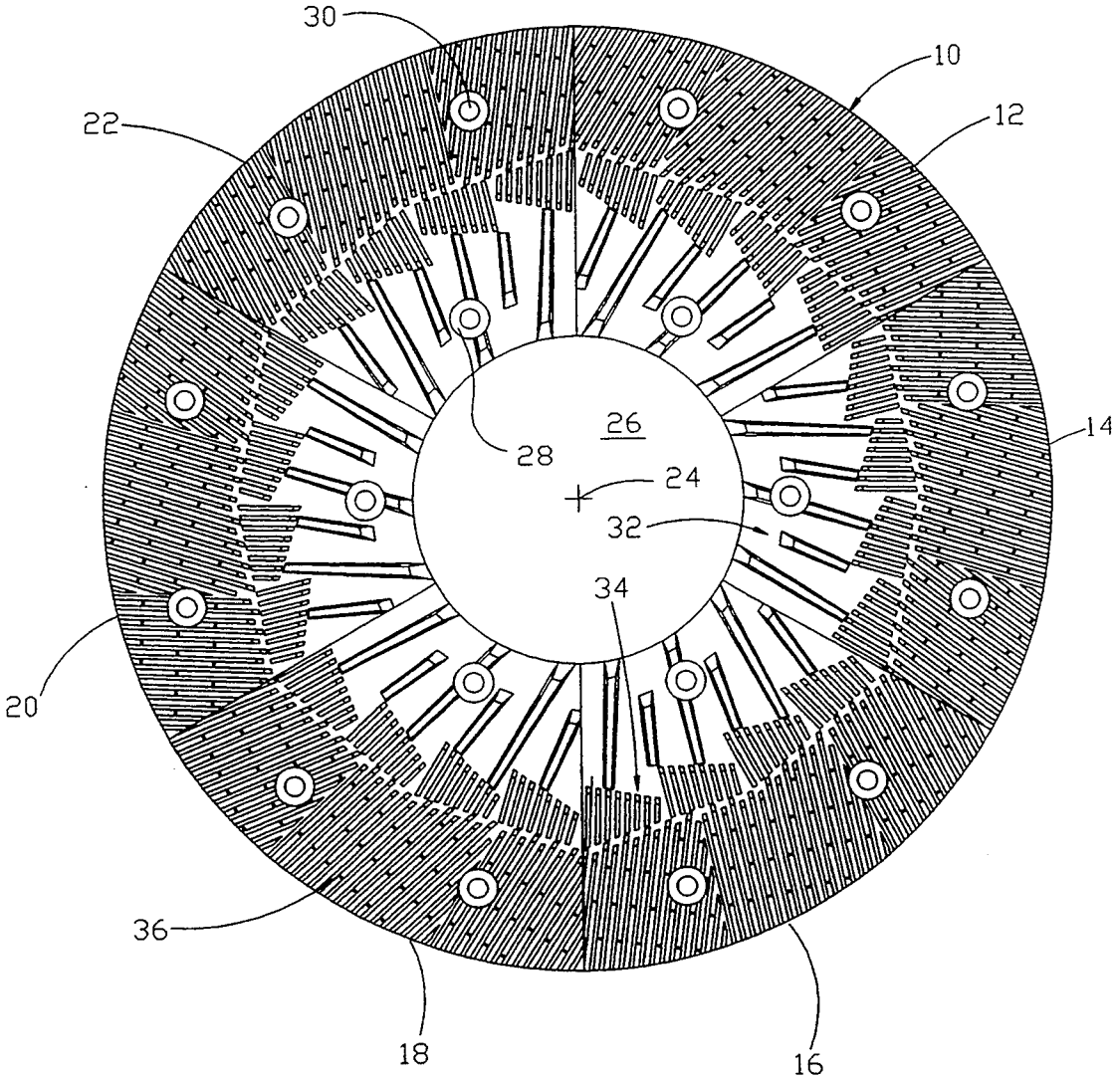
FIG. 1 is a frontal view of a plate constituted from a plurality of plate segments in accordance with a first embodiment of the invention, for use in a low consistency pulp refiner.

FIG. 1 is a frontal view of a substantially circular refiner plate 10, constituted from a plurality of segments 12,14,16,18,20 and 22, each of which has the general shape of a truncated sector of a circle. The plate 10 and associated segments are centered at 24, which also lies on the rotation axis of the disc (not shown) on which the plate 10 is mounted for rotation relative to an opposing plate in a refiner. The truncated nature of each segment defines a central opening 26 through which feed material to be refined is introduced at the inner portion of each segment, in a manner well known in the relevant field. As is also well known, each plate includes means such as shown at 28,30, for attaching the segment to the disc, whereby at periodic intervals, the entire plate can be replaced in the field, by the replacement of the individual segments.

As viewed in FIG. 1, the plate 10 can be considered has having three substantially annular zones, which are spaced apart in radially successive relationship. The first annular zone 32 receives feed material from central opening 26 and reduces the size thereof while imparting a radial directionality, whereby the material enters the second annular zone 34, where a relatively coarse refining action occurs. The partially refined material continues to move outwardly into the third, outer refining zone 36, whereupon the refined material emerges at the periphery of the plate 10 for collection in a manifold and discharge from the refiner.

Figure 2:
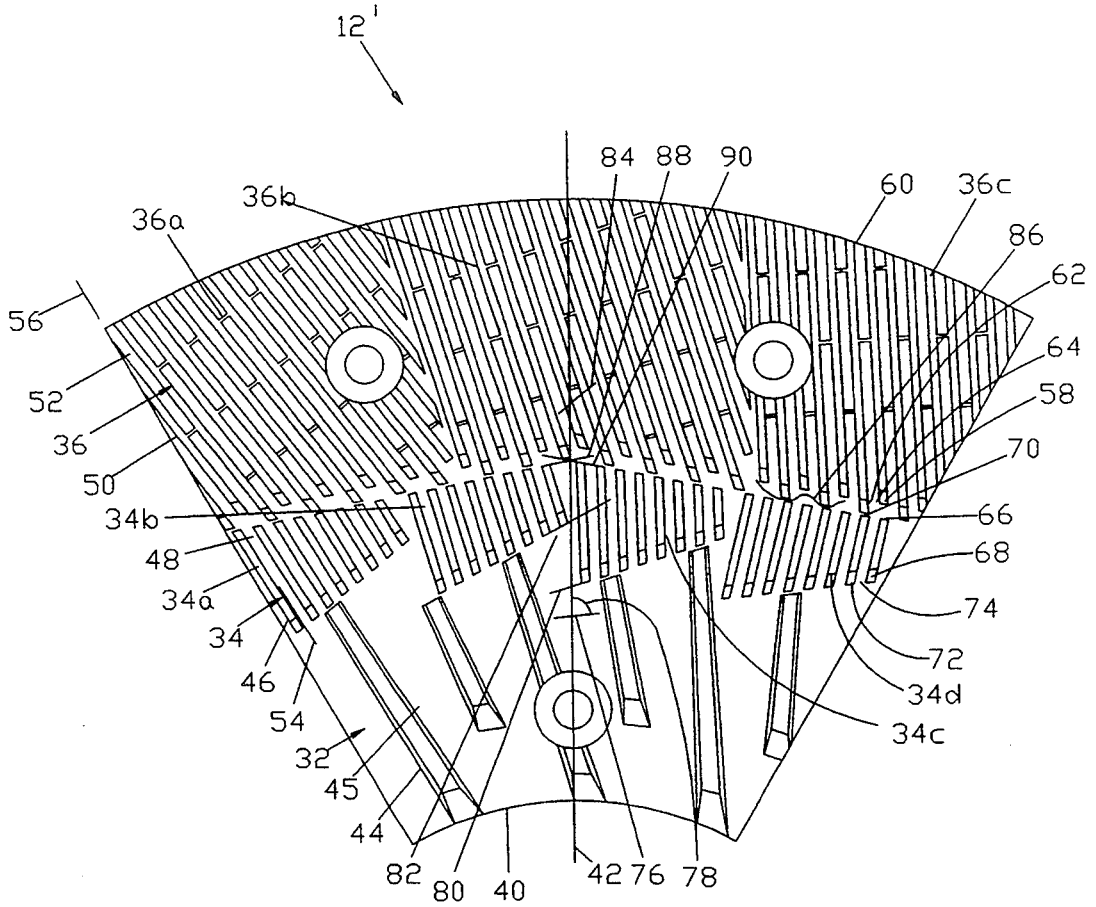
FIG. 2 is an enlarged view of one plate segment from the plate shown in FIG. 1.

FIG. 2 is a more detailed view of one plate segment 12' but in reverse equivalent to segment 12 of FIG. 1. The segment has a periphery 38 and an inner border 40, between which a segment central axis 42 can be defined in a manner that passes through the plate center 24 (as shown in FIG. 1) while bisecting the borders 38,40 and therefore the segment. The first annular zone 32 can be considered a feed zone having a plurality of breaker bars 44 and intervening spaces or grooves 48 which define a feed path 45, generally extending substantially radially. As used herein, "substantially radially" should be understood as referring to predominantly in the outward direction from inner border 40 toward periphery 38.

The second zone 34 is constituted by a plurality of second zone regions 34A,34B,34C and 34D, which are laterally situated relative to each other, but within the general annular band defining zone 34. The common characteristic of each of the regions in zone 34 is that the substantially radially extending bars 46 and the intervening grooves 48 are substantially of uniform width. In particular, the grooves 48 have a smaller width than the grooves 45 of the feed zone 32.

Similarly, the third, outer zone 36 is constituted by a plurality of regions 36A,36B and 36C, which are laterally situated relative to each other within the outer annulus. In each region of outer zone 36, a plurality of uniform bars 50 and intervening grooves 52 accomplish the further refining action relative to zone 34.

It should be appreciated that within a particular region such as 34A, the bars and grooves 46,48, are substantially parallel, with each groove having a centerline 54. Similarly, bars 50 and grooves 52 in outer zone region 36A are substantially parallel, with each groove having a centerline 56. In general, the groove width in the relatively inner zone 34 is greater than the groove width in the relatively outer zone 36, and the centerlines of the grooves in the regions of the zone 34 are not collinear with the centerlines of the grooves in the regions of zone 36. In other words, the groove centerlines 54 in region 34A are not collinear with the groove centerlines 56 in region 36A.

The relatively outer zone 36 is substantially radially spaced from the relatively inner zone 34 as the segment (and full plate) are viewed on a gross scale, and likewise, radially adjacent regions such as 36C and 34D are spaced apart. This results from the spacing of the bars in the two regions. Each bar in region 36C has an inner end 58 and an outer end 60 which defines a bar length. The inner end 62 of an adjacent bar and inner end 58, together define an inlet 64 for the intervening groove.

In like manner, the outer bar end 64 and inner bar end 68 in region 34D define an individual bar length, with the inner end 72 of an adjacent bar defining an inlet 74 for the intervening groove in region 34D.

A line drawn across the inlets 72 defined by the bar ends 68,72 in region 34D, if extended toward central axis 42, intersects the axis at 76, forming an acute angle 78. If a similar line joining the lower bar ends of adjacent region 34C is also extended to central axis 42, the intersection occurs at 80, which is at a different location along axis 42, than the intersection 76. The analogous intersections occur at 82 for region 34B, and at 84 for region 34A. Thus, none of the inlet extension lines associated with the regions of zone 34, intersect the central axis 42 of the segment at the same location. The acute angles formed at each of the intersection lines associated with the regions in zone 34A, preferably form a different angle with the central axis 42, but in any event, the angle formed by two regions within a segment, differ by at least 5°. Preferably, the angle for adjacent regions also differ by at least 5°.

It should also be appreciated that the lines joining the groove inlets for the laterally successive regions 34A,34B,34C and 34D, if connected to each other rather than extended to the axis 42, form a staggered, jagged, or "saw tooth" with the periodicity of the saw tooth defined by the periodicity of the successive regions in zone 34A.

Generally, it should be understood that in the embodiment of FIG. 2 the significant angular relationships of the inlet lines from region-to-region, and in particular the overall saw tooth pattern, is situated at the transition from the feed zone 32 to the first refining zone 34. Moreover, the opposed plate in the refiner, will carry a similar array of regions constituting zone 34. As these plates rotate relative to each other, the bar ends along angled inlet lines effectuate a "wiping" action relative to each other, such that the "wiping point" in the wiping action, varies cyclicly with respect to its radial distance from center 24. This is in sharp contrast to many conventional plates and segments, where the inlet line is an arc of constant radius and no periodic wiping occurs.

Although the total length of bars and grooves in region 34 is reduced relative to the conventional design, the loss in refining capacity is in most instances, negligible, and in any event more than compensated by the longer lifetime and relatively trouble-free operation afforded by the present invention. It should be appreciated that, as a rule of thumb, two-thirds of the refining work is accomplished in the outer one third of the refining gap between relatively rotating plates. Thus, a reduction in the number or extent of bars and grooves in the relatively inner zone 34, has a less disadvantageous consequence than would a similar reduction of bars and grooves in the outer zone 36. Moreover, the reduction of bars and grooves in zone 34 is at the inner ends of the bars, i.e., at the transition from the innermost, feed zone 32. Therefore, in accordance with the invention, the advantage of opening up inlet flow area to facilitate the feeding of material from the breaker zone 32 into the first refining zone 34 via asymmetric and/or saw tooth inlet lines as discussed above, is achieved at precisely the area where a reduction in the bars and grooves has a minimum adverse impact on refining capacity.

In the embodiment shown in FIG. 2, the invention can also be implemented at the transition between the first refining region 34 and the second refining region 36. Referring again to region 34D, the outer ends 66 of the bars form a straight line which, if extended to the axis 42, intersect at 88. The outer ends of the bars in region 34C also lie on this line. Similarly, the outer ends of the bars in regions 34A and 34B fall on a straight line which intersects the central axis 42 at 90. Moreover, the intersection point is the same, and the angles formed by the two lines at 88 and 90 are the same. Although this situation may in some instances be found in the prior art, the present invention achieves an advantageous improvement in the feeding at the inlet such as 64 to the outer zone 36, by staggering the inner ends 58,62 of the adjacent bars of the relatively outer zone 36. Thus, the "channel" defined between the inner ends of the bars in zone 36 and the outer ends of the bars in zone 34, has a non-uniform width as one moves along the centerline 86 of the channel, toward the central axis 42. The variation in channel width is preferably at least 100% from the average width. The centerline 86 of the channel follows a serpentine path which is analogous to, but on a smaller scale than, the saw tooth line described above with respect to the inlets of zone 34. This staggering has the similar advantageous effect of diffusing the restrictions that arise during the relative rotation of the plates across a narrow gap, rather than concentrating the restrictions at or near a substantially constant radius.

Figure 3:
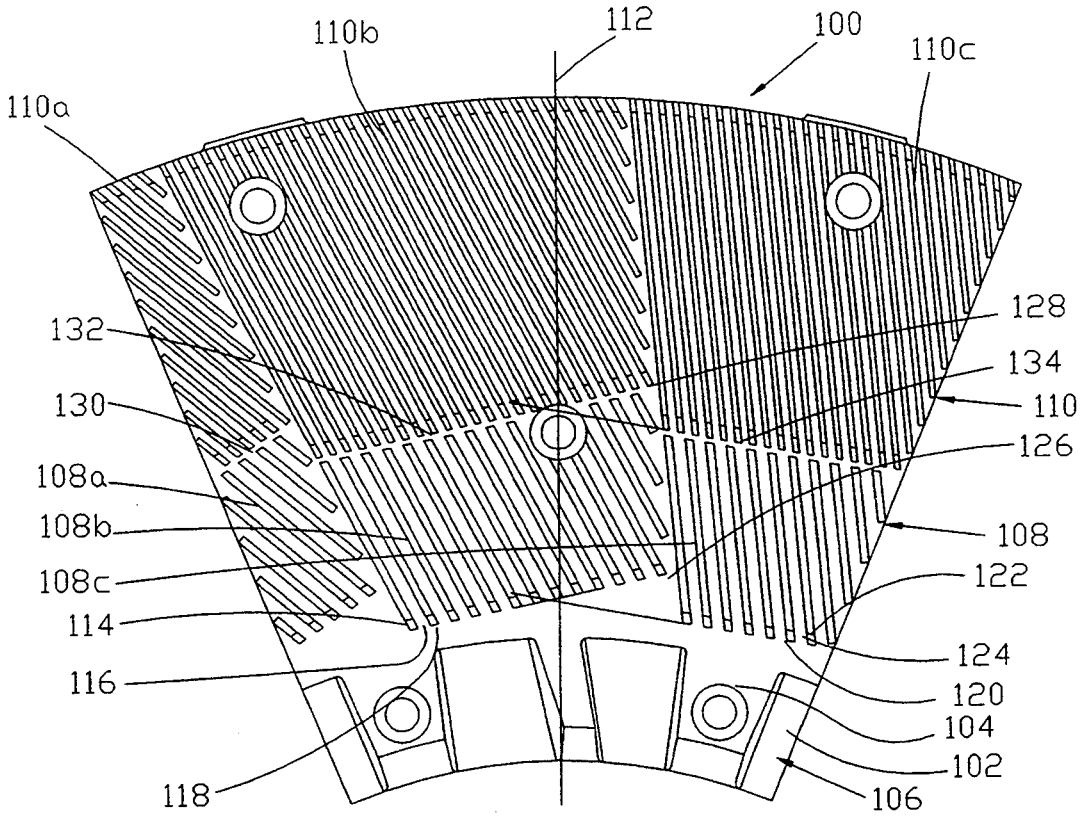
FIG. 3 is a frontal view plate segment from a second embodiment, usable in a low consistency refiner.

FIG. 3 shows another embodiment of a plate segment 100 for a low consistency refiner, having coarse bars 102 and grooves 104 defining a feed zone 106, from which feed material flows outwardly and undergoes refining in a first refining zone 108 and a second refining zone 110. In this embodiment, the refining zone 108 is constituted by three regions 108A,108B, and 108C, and the outer zone 110 is also constituted by three regions, 110A,110B, and 110C. The bars and grooves within regions 108A and 110A, are substantially parallel, although the groove width in region 110A, is less than the groove width in region 108A. Similar relationships are found in regions 108B and 110B, and 108C and 110C. In this segment, the regions are situated asymmetrically relative to the segment central axis 112. The significant features of this embodiment, however, are not defined relative to the central axis 112, but rather are directed to the provision of an irregular, saw toothed inlet line between zones 106 and 108, and between zones 108 and 110. In a manner similar to that described with respect to FIG. 2, a region such as 108B has an inlet 116 for each groove, defined between bar ends 114,118. These bar ends when connected form a straight line. In the laterally adjacent region 108C, the inner bar ends 120,122 also define inlets 124 and establish a straight line. It can be seen in FIG. 3, that the straight line drawn across the inlets in region 108B, has a discontinuity, or jag 126, if continued to the inlets of region 108C.

This has the same effect in terms of advantageous feeding, as arises with the saw tooth inlet line described with respect to zone 34 in FIG. 2.

FIG. 3 also shows that a similar jag and overall saw tooth effect is achieved at 128, between the zone 108 and zone 110. In general, the successive channels 130,132, and 134 defined between regions 108A and 110A, 108B and 110B, and 108C and 110C, are of substantially uniform width, except at the jags 128, which occur at the lateral transition between successive regions in a given zone. The straight line of each channel 130,132, and 134 if extended to central axis 112, form acute angles therewith, thereby producing a wiping action relative to the opposed plate. In addition, the staggering of the channels which produces the jag 128 and associated saw toothed effect, results in discontinuities between the lateral ends of channels at adjacent regions, thereby further avoiding local pinching effects.

Figure 4:
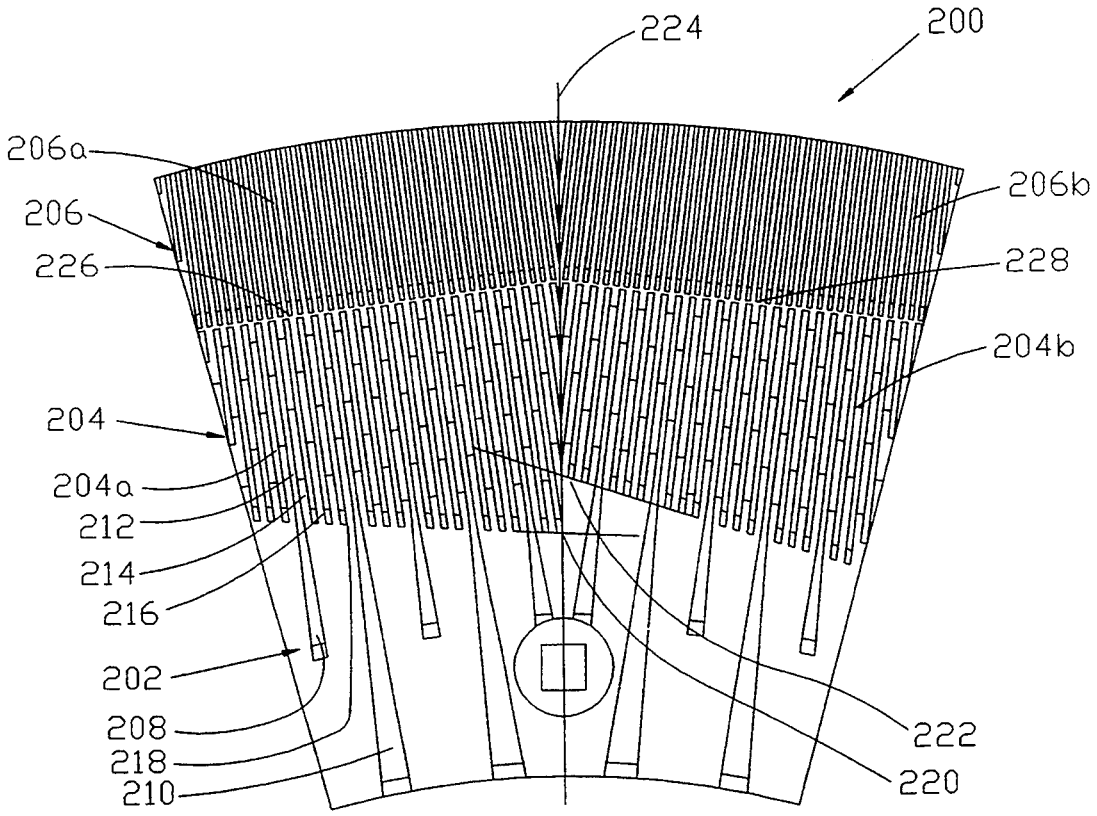
FIG. 4 is a frontal view of a plate segment according to a third embodiment for the feed end plate of a high consistency refiner.
Figure 5:
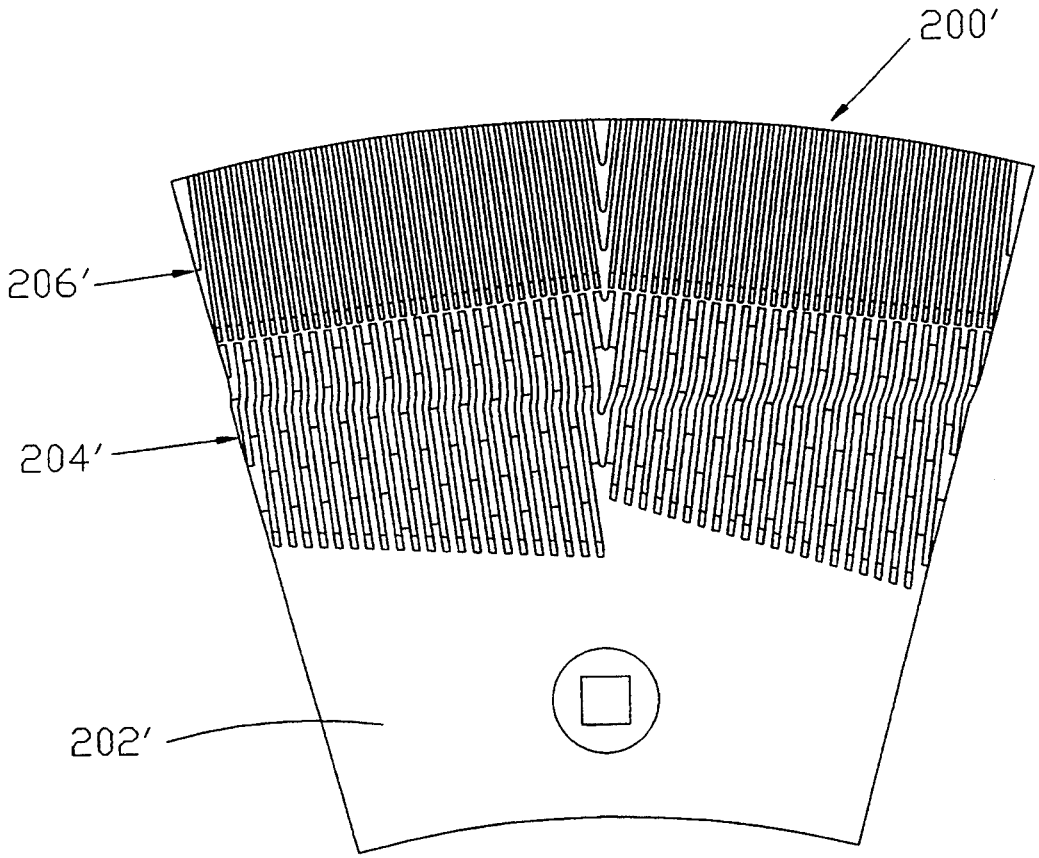
FIG. 5 is a frontal view of a plate segment for the control end plate which opposes the feed end plate depicted in FIG. 4.

FIGS. 4 and 5 show segments 200 for the feed end plate, and 200' for the opposed control end plate, for a high consistency refiner. With particular reference to the feed end plate segment of FIG. 4, three zones are evident, consisting of feed zone 202, an inner, first refining zone 204, and outer, second refining zone 206. The first inner refining zone 204 is constituted by regions laterally adjacent 204A, 204B, and the outer zone 206 is constituted by laterally adjacent regions 206A,206B, such that left and right regions of a given zone, are situated on either side of the segment central axis 224. The control end segment of FIG. 5 has a smooth surface in feed zone 202' whereas zone 204' and 206' are identical to zones 204 and 206 of FIG. 4.

The feed zone 202 has a plurality of substantially radially extending bars 208, 210, which are of different lengths. Moreover, these bars taper within the feed zone 202 until they reach and extend outwardly in refining zone 204, where they are of the same width and are substantially indistinguishable from, the other bars 212,214,216, in that zone. As a result, the inlets to the grooves in zones 204, are of two types. One type of inlet is formed between the inner ends of bars such as 214,216, which are adjacent each other, whereas another inlet such as 218 is formed between the inner end of bar 216 and the side wall of the elongated bar 210. Inspection of FIG. 4 will reveal that approximately half the grooves in zones 204 have inlets formed by the inner ends of adjacent bars, whereas approximately half the grooves have inlets formed by the inner end of one bar and the extended side wall of an elongated bar.

The inner ends of bars such as 212,214,216 which terminate in the region 204, define the inlet to each groove in the region. A line connecting the inner ends of these bars in the left region 204A when extended to the central axis 224 forms a first acute angle with the central axis at 220, and a line connecting the inner ends of the bars in the region 204B when extended to the central axis forms a second acute angle at 222. The left and right lines as so extended, do not intersect at the central axis 224, thereby forming a jag or saw tooth 222 at the central axis. Moreover, preferably, the acute angles formed at the intersections 220,222, differ by at least about 5°. This orientation of the lines results in the lines being asymmetric about the central axis.

In the embodiment of FIGS. 4 and 5, the significant advantages of the oblique inlet lines and saw tooth jag at the transition between the feed zone 202 and the first refining 204 are achieved at a radial area that can accommodate a slight reduction in the total length of bars and grooves, without significant loss in refining capacity. However, with high consistency refiners the removal of bars and grooves near the entrance to the outer zone 206 may have an undesirable effect on refining capacity. Thus, in the embodiment shown in FIGS. 4 and 5, the straight channels 226,228 are of substantially uniform width, and intersect at the same point on central axis 224, at the same angle, as is known in the prior art.

Figure 6:
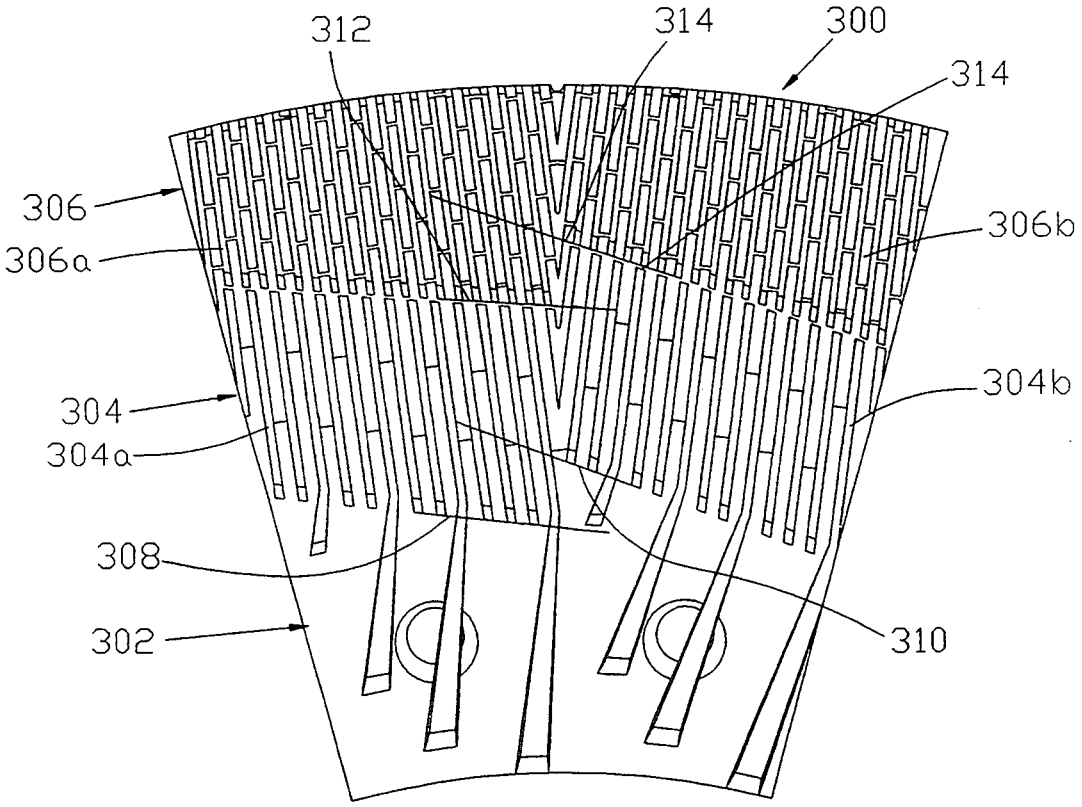
FIG. 6 is a frontal view of a plate segment for a fourth embodiment, usable in a high consistency refiner.

FIG. 6 illustrates yet another embodiment 300 usable in a high consistency refiner, wherein each segment has three zones 302,304,306, with zone 304 constituted by regions 304A,304B and zone 306 by regions 306A,306B, in a manner analogous to the embodiment shown in FIG. 4. In the embodiment of FIG. 6, however, the inlet lines 308, 310 form a saw tooth at the transition between zones 302 and 304, and in addition, the inlet lines 312,314 form a saw tooth transition between zones 304 and 306. Whereas the saw tooth at the inlet to zone 304 has a relatively enlarged open flow space, the saw tooth between zones 304 and 306 does not. The left side channel along straight line 312 and the right side channel along straight line 314 are connected at the jag, via a portion of groove 314 which extends therebetween. In this embodiment, the enhanced wiping action of obliquely oriented, linear channels 312,314 situated asymmetrically is realized, while retaining to the extent possible, maximum bar and groove density in the radially outer portion of the plate, to maximize refining capacity. In the embodiment of FIG. 6, both the inner pair of lines 308,310 and the outer pair of lines 312,314, are asymmetric about the central axis of the segment.

It should be appreciated by those skilled in the art, that the saw tooth inlet line relationship in the embodiment of FIGS. 4–6 between the feed zones 202,302 and the first refining zones 204,304 not only facilitates the unrestricted, substantially radially outward flow of material, but it also facilitates the substantially radially inward flow of steam that is generated in the refining zones 204,206 and 304,306. The pressure profile which is present during high consistency refining tends to have a peak near the inlet channels 312,314 in zone 306, with some of the steam flowing outwardly and some flowing radially inwardly as backflow through the feed zone 302 for removal in a manner known in the art. The backflowing steam opposes the substantially radially outward flow of feed material across lines 308,310 but, with the present invention, the increased flow area and minimization of restrictions, facilitates the flow of feed material substantially radially outwardly, and the flow of steam substantially radially inwardly.

I claim:

1. A plate attached to a substantially circular disc for installation in a rotating disc refiner, the disc having a center, a circumferential periphery, and a radius extending from said center to said periphery, and the plate being formed by a plurality of adjacent plate segments, each segment having a central axis extending radially and a pattern of raised bars and grooves defined between the bars, wherein said pattern comprises:

a first, radially inner zone having a first arrangement of laterally spaced bars and intervening grooves, each bar having a length defined by radially inner and outer ends and each groove having a width and a longitudinal centerline;

a second zone situated radially outward of said first zone and having a second arrangement of laterally spaced bars and intervening grooves, such that each bar has a length defined by radially inner and outer ends and each groove has a width and a longitudinal centerline, wherein the groove centerlines of the second zone are not collinear with the groove centerlines of the first zone; and the outer ends of the bars in the first zone and the inner ends of the bars in the second zone are spaced from each other non-uniformly and thereby define a channel therebetween of periodically varying width.

2. The plate of claim 1, wherein the variation of the channel width from the average channel width, is at least about 100%.

3. A plate attached to a substantially circular disc for installation in a rotating disc refiner, the disc having a center, a circumferential periphery, and a radius extending from said center to said periphery, and the plate being formed by a plurality of adjacent plate segments, each segment having a central axis extending radially and a pattern of raised bars and grooves defined between the bars, wherein said pattern comprises:

a first pair of left and right, radially inner first regions on either side of the central axis, each first region having a first series of bars and grooves extending substantially in parallel such that each bar has a length defined by radially inner and outer ends and each groove has a first uniform width and longitudinal centerline;

a second pair of left and right second regions situated radially outwardly of said first pair of regions, on either side of the central axis, each of the second regions having a second series of bars and grooves extending substantially in parallel such that each bar has a length defined by radially inner and outer ends and each groove has a second uniform width and longitudinal centerline, the second width being smaller than the first width such that the groove centerlines in the left first region are not collinear with the groove centerlines of the left second region and the groove centerlines of the right first region are not collinear with the groove centerlines of the right second regions;

the outer ends of the bars in the left first region and the inner ends of the bars in the left second region are spaced from each other and define a channel therebetween to the left of and transverse to the central axis;

the outer ends of the bars in the right first region and the inner ends of the bars in the right second region are spaced from each other and define a channel therebetween to the right of and transverse to the central axis; wherein the left and right channels are asymmetric about said central axis of the segment.

4. The plate of claim 3, wherein the left and right channels taken in succession around the plate, define a saw-tooth shape.

5. A plate attached to a substantially circular disc for installation in a rotating disc refiner, the disc having a center, a circumferential periphery, and a radius extending from said center to said periphery, and the plate being formed by a plurality of adjacent plate segments, each segment having a central axis extending radially and a pattern of raised bars and grooves defined between the bars, wherein said pattern comprises:

a first, radially inner zone having a first arrangement of laterally spaced bars and intervening grooves, each bar having a length defined by radially inner and outer ends and each groove having a width and a longitudinal centerline;

a second zone situated radially outward of said first zone and having a second arrangement of laterally spaced bars and intervening grooves, such that each bar has a length defined by radially inner and outer ends and each groove has a width and a longitudinal centerline, wherein the groove centerlines of the second zone are not collinear with the groove centerlines of the first zone; and the outer ends of the bars in the first zone and the inner ends of the bars in the second zone are spaced from each other non-uniformly and thereby define a channel therebetween of non-uniform width, wherein the channel width varies from an average channel width by at least about 100%.

6. A plate attached to a substantially circular disc for installation in a rotating disc refiner, the disc having a center, a circumferential periphery, and a radius extending from said center to said periphery, and the plate being formed by a plurality of adjacent plate segments, each segment having a central axis extending radially and a pattern of raised bars and grooves defined between the bars, wherein said pattern comprises:

a pair of left and right regions on either side of the central axis, each region having a series of laterally alternating bars and grooves extending substantially in parallel such that each bar has a length defined by radially inner and outer ends, and each grove has an inlet defined by the radially inner end of at least one bar;

wherein a line connecting the inner ends of the bars in the left region when extended to the central axis forms a first acute angle to the central axis and a line connecting the inner ends of the bars in the right region when extended to the central axis forms a second acute angle with the central axis;

wherein the first and second acute angles differ by at least 5°; and wherein the left and right lines when extended across the segment, do not intersect.

* * * * *